US008062144B2

(12) United States Patent
Conway

(10) Patent No.: US 8,062,144 B2
(45) Date of Patent: Nov. 22, 2011

(54) PUTT AND SWING TRAINING PLATE

(76) Inventor: John Conway, Freeville, NY (US)

( * ) Notice: Subject to any disclaimer, the term of this patent is extended or adjusted under 35 U.S.C. 154(b) by 0 days.

(21) Appl. No.: 12/723,947

(22) Filed: Mar. 15, 2010

(65) Prior Publication Data

US 2010/0273563 A1 Oct. 28, 2010

Related U.S. Application Data

(60) Provisional application No. 61/172,367, filed on Apr. 24, 2009.

(51) Int. Cl.
*A63B 69/36* (2006.01)

(52) U.S. Cl. ..... 473/218; 473/257

(58) Field of Classification Search ..... 473/218, 473/257, 265, 270–273, 278, 279
See application file for complete search history.

(56) References Cited

U.S. PATENT DOCUMENTS

| | | | | |
|---|---|---|---|---|
| 3,860,247 | A * | 1/1975 | Taylor | 473/218 |
| 3,868,116 | A * | 2/1975 | Ford et al. | 473/218 |
| 4,538,815 | A * | 9/1985 | Poirier | 473/218 |
| 5,478,081 | A * | 12/1995 | Terry | 473/218 |
| 6,949,029 | B1 * | 9/2005 | Strande | 473/257 |

* cited by examiner

*Primary Examiner* — Nini Legesse
(74) *Attorney, Agent, or Firm* — Brown & Michaels, PC

(57) ABSTRACT

A golf training plate including a body rectangular in shape comprising a top surface, a left side, a right side, a forward side and a rear side having two feet placement cutouts extending from the rear side towards the forward side and an alignment arm in the shape of an "L" comprising a short portion adjacent the right side of the body and a long portion, substantially parallel to the forward side of the body defining a training space for placement of a ball. The body and the alignment arm each have a series of ball alignment lines to aid in placement of the ball relative to the feet placement cutouts.

12 Claims, 8 Drawing Sheets

PUTT AND SWING TRAINING PLATE

REFERENCE TO RELATED APPLICATIONS

This application claims one or more inventions which were disclosed in Provisional Application No. 61/172,367, filed Apr. 24, 2009, entitled "PUTT AND SWING TRAINING PLATE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of golf. More particularly, the invention pertains to training aids for golf.

2. Description of Related Art

Golf has become a popular sport and many people take lessons from instructors in order to improve their golfing skills. One area that is always under improvement is the golf swing. In some cases, players set up tees in a few places to help them make their swing more consistent, but even with an instructor, an individual's golf swing is difficult to consistently monitor and alter as necessary to help them achieve a consistent swing that enables the user to accurately get the ball to travel to the hole.

SUMMARY OF THE INVENTION

A golf training plate including a body rectangular in shape comprising a top surface, a left side, a right side, a forward side and a rear side having two feet placement cutouts extending from the rear side towards the forward side and an alignment arm in the shape of an "L" comprising a short portion adjacent the right side of the body and a long portion, substantially parallel to the forward side of the body defining a training space for placement of a ball. The body and the alignment arm each have a series of ball alignment lines to aid in placement of the ball relative to the feet placement cutouts.

DETAILED DESCRIPTION OF THE INVENTION

Figure 1:
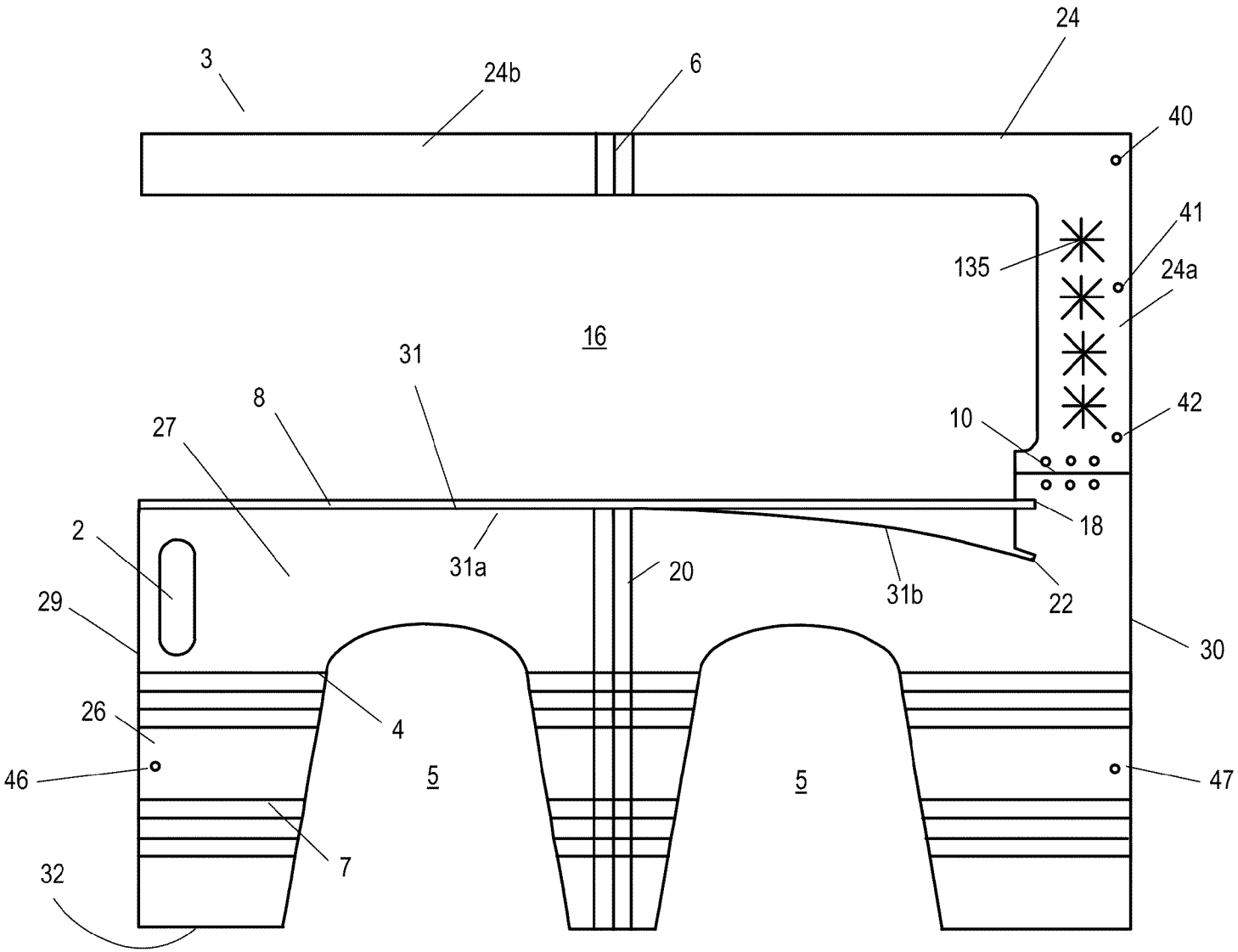
FIG. 1 shows a top view of the training plate in a first training position.

FIGS. 1-4 show a training plate 3 of a first embodiment for designating proper setup positioning for swinging the golf club and for monitoring the club head take away and travel of the club head prior to impact with the ball. The training plate 3 of the first embodiment may be used for training on putting shots, shots being less than ten feet away from the tee, including but not limited to pendulum putting shots and natural arch putting shots, or for iron shots, shots being greater than ten feet away from the tee.

The training plate 3 includes a generally rectangular body 26 and an L-shaped alignment arm 24. The body 26 has a top surface 27, a bottom surface (not shown), a left side 29, a right side 30, a forward side 31, and a rear side 32. Holes 46 and 47 are present on the body to secure the body to the ground using golf tees or stakes if necessary. The forward side 31 of the body 26 has a straight portion 31*a* and a portion 31*b* that is radiused back in order to establish a curved portion 31*b*. A straight arm 8 with a length is firmly attached to the forward side 31 of the training plate and has a flexible portion 8*a* at one end which fits into slots 18, 22 on the right side 30 of the body 26. If the flexible portion 8*a* of the arm 8 is received by slot 18, the arm 8 is straight from the left side 29 of the body to the right side 30 of the body 26, substantially parallel to an alignment arm 24 and does not follow the curved portion 31*b* of the forward side 31 of the body 26. If the flexible portion 8*a* of the arm 8 is received by slot 22, the flexible arm 8 will follow the curved portion 31*b* of the forward side 31 of the body 26.

Figure 7:
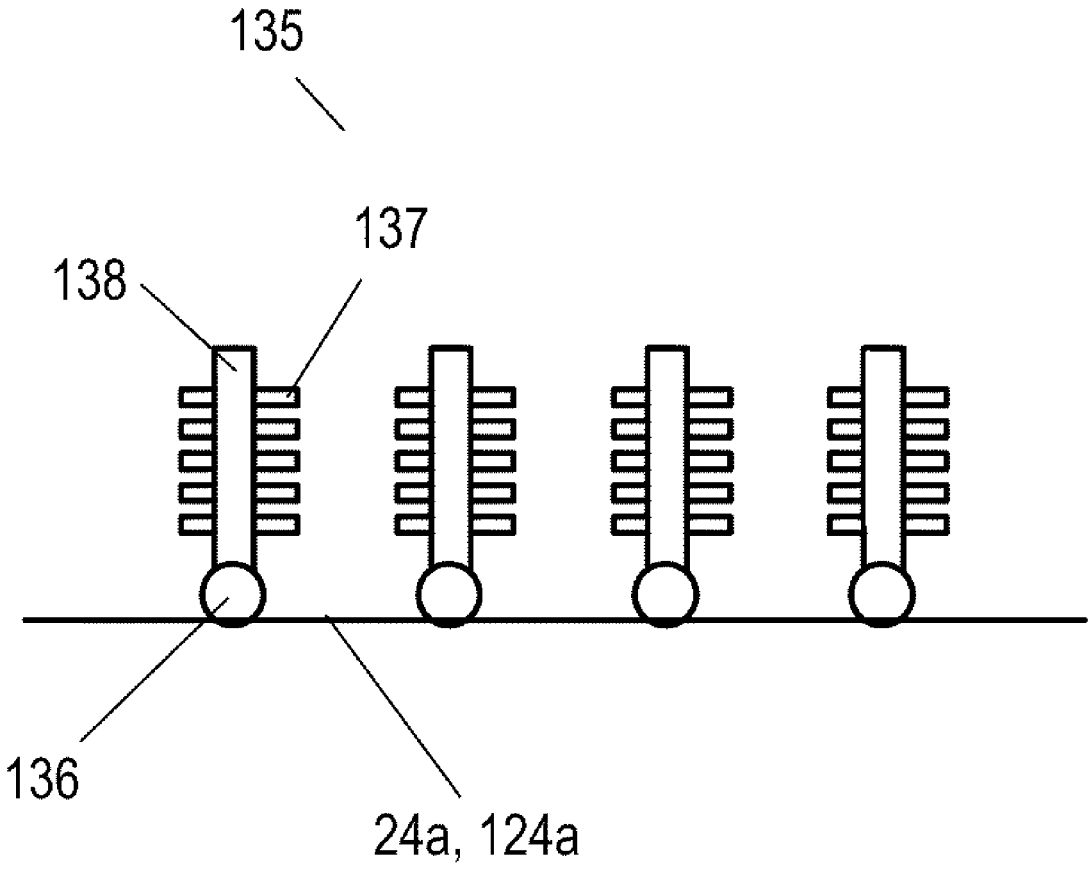
FIG. 7 shows a side view of tabs.

The alignment arm 24 is rotatably connected to the body 26, preferably through a hinge 10. The alignment arm 24 is preferably L-shaped having a short portion 24*a* and a long portion 24*b*, with the longer portion 24*b* of the "L" is substantially parallel to the forward side 31 of the body 26. A series of holes 40, 41, and 42 are present along the short portion 124*a* of the alignment arm 124 and may used with golf tees or some other type of stake to secure the alignment arm to the ground. Preferably along the short portion 24*a* of the alignment arm 24 are a series of swing alignment tabs 135 that are each individually pivotably connected to the arm 24*a*. A side view of the swing alignment tabs 135 is shown in FIG. 7. The swing alignment tabs 135 are preferably comprised of a rod 138 pivotably attached to a pivot 136 with a series of tabs 137. The tabs 137 may also be feathers, bristles, brushes or any other material that may be knocked down by the golf club head without injuring the head of the club. The placement and the fact that the series of swing alignment tabs 135 can easily be knocked down indicates where the golf club head is on the swing take-away and the location and travel of the club head before impacting the ball. The tabs 135 may be reset to continue practicing and learn the correct inside swing path of the golf club head.

Figure 2:
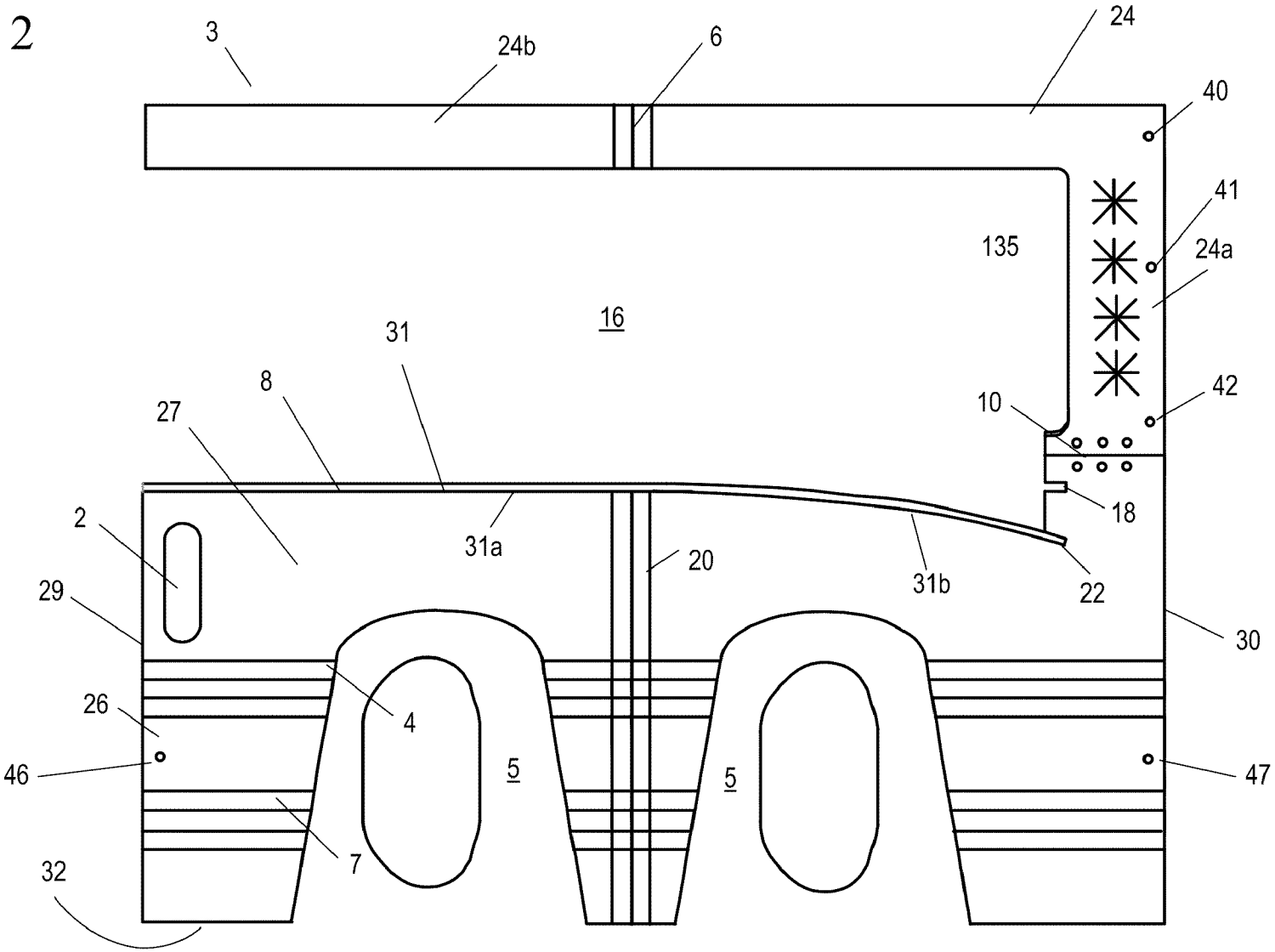
FIG. 2 shows a top view of the training plate in a second training position.
Figure 3:
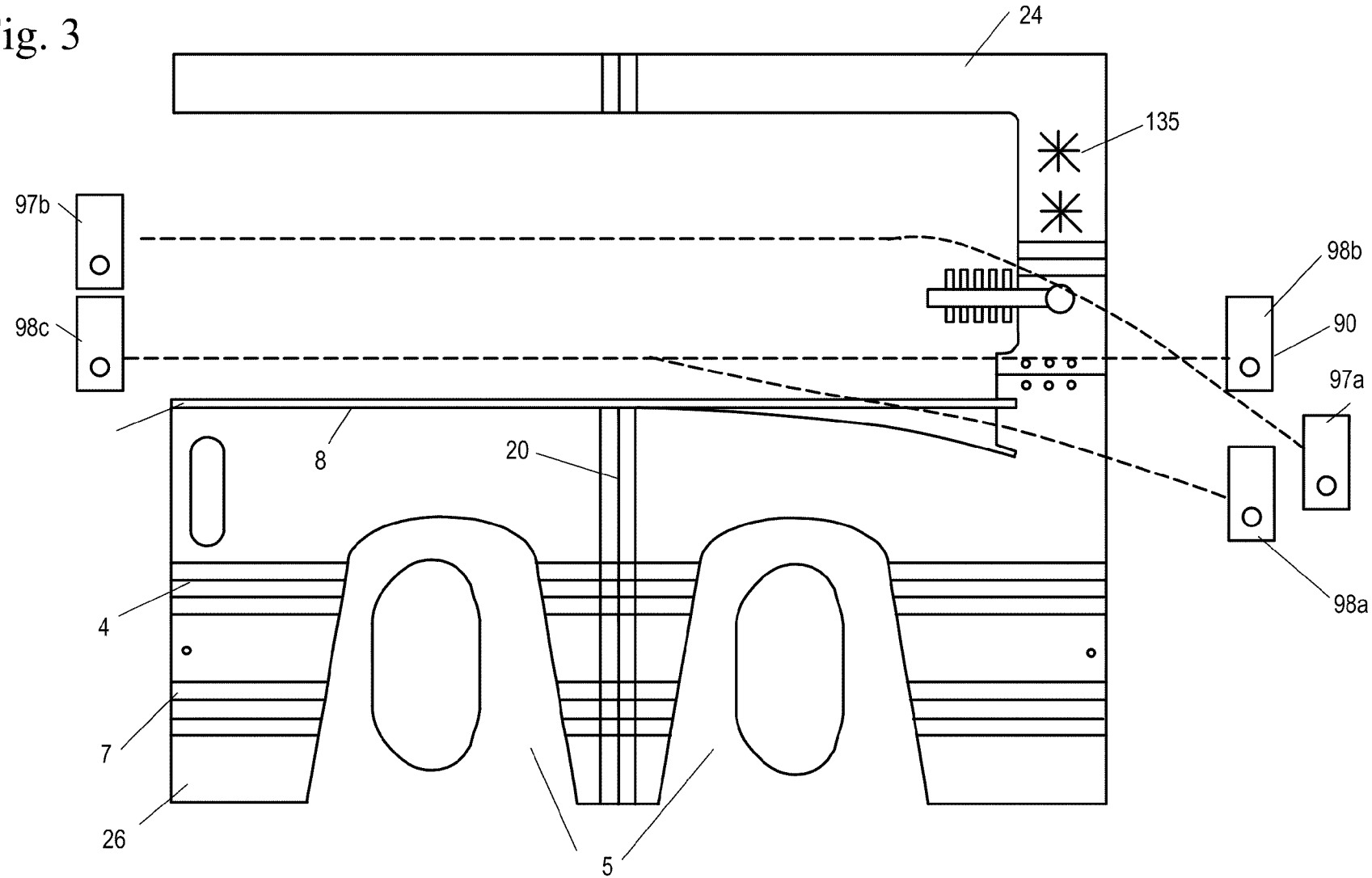
FIG. 3 shows a schematic of the training plate of the first embodiment used by a golfer.
Figure 4:
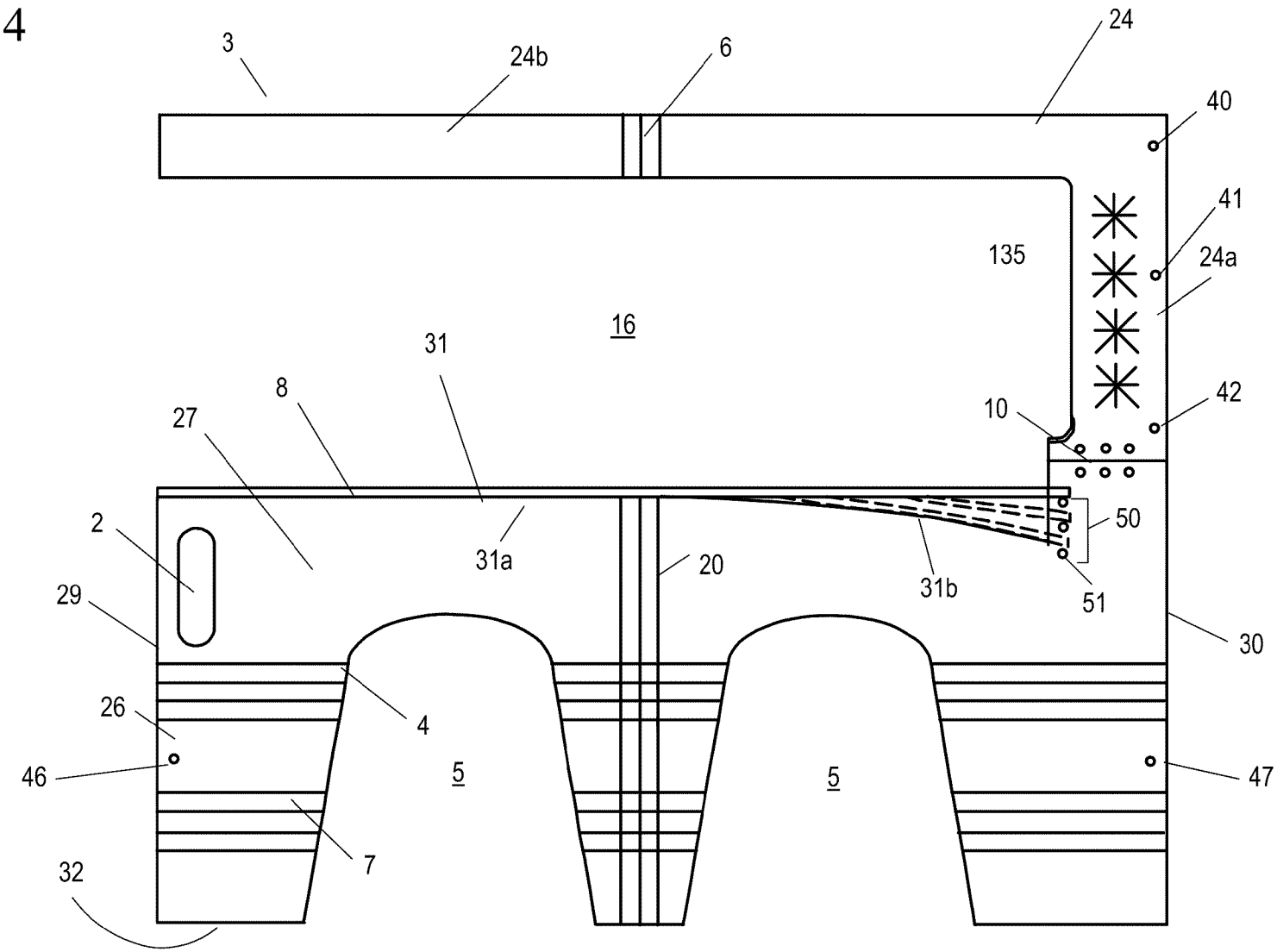
FIG. 4 shows a top view of a second embodiment of the training plate.

When the training plate 3 is laid flat and in training position, as shown in FIGS. 2-4, a training space 16 is defined between the long portion 24*b* of the alignment arm 24, the short portion 24*a* of the alignment arm 24, the forward side 31 of the body 26, and a flexible arm 8. When the training plate is used by a user, at least one golf ball (not shown) is placed within the training space 16.

The body 26 defines two feet placement cutouts 5 that are widest at the rear side 32 of the body 26 and become narrower as the cutouts 5 approach the forward side 31 of the body 26. The top surface 27 of the body 26 preferably has a series of feet placement lines 4, 7 adjacent to the feet placement cutouts 5 to aid the user with proper feet placement that run parallel to the alignment arm 24. A first set of feet placement lines 4 are located where the toes of the users would be when their feet are in the feet placement cutouts 5 and the second set of feet placement lines 7 are located where the heel of the users would be present when their feet are in the feet placement cutouts 5.

The top surface 27 of the body 26 also includes ball alignment lines 20 which are comprised of a series of parallel lines that are spaced apart a distance from each other, between the two feet placement cutouts 5, with at least one of the lines located along a center line that is located between the left side 29 and right side 30 of the body 26 and perpendicular to the long portion 24*b* of the alignment arm 24. The lines 20 preferably extend from the rear side 32 of the body 26 to the forward surface 31 of the body 26. The parallel lines 20 are preferably spaced apart from each other a distance of ⅝". The long portion 24*b* of the alignment arm 24 has corresponding ball alignment lines 6 which are comprised of a series of parallel lines that are aligned with the series of parallel lines 20 on the top surface 27 of the body 26, where at least one of the lines is located along a center line of the long portion 24*b* of the L-shaped alignment arm 24. The center line on the top surface 27 of the body 26 and the center line on the long portion 24*b* of the alignment arm 24 are used for alignment and placement of the golf ball within the training space 16.

A ball may be aligned with the training space 16, using three center lines, the center line 20 on the body 26 perpendicular to the long portion 24*b* of the alignment arm 24 and the center line 6 on the long portion 24*b* of the alignment arm 24.

The training plate may fold up into a travel position and can be unfolded back into a training position. When the training place is folded, alignment arm 24 is rotated on the hinge 10 and the short portion 24*a* of the alignment arm 24 lays adjacent to the end of the flexible arm 8 and the long portion 24*b* of the alignment arm 24 lays across the rear side 32 of the body 26. The alignment arm 24 is secured to the body by hook-and-loop fastener or Velcro®. A handle 2 is preferably present near the left side 29 of the body 26 and is used to easily carry the folded training plate.

The training plate is preferably made of a carbon polymer material.

To use the training plate for natural arch putting shots of ten to forty feet away from the tee, a user places the training plate a specific distance away from the hole or other chosen marker. The user may or may not use a tee or other stake to secure the training plate to the ground using holes 40, 41, 42, 46, and 47. A user then steps into the feet placement cutouts 5 and aligns their toes with one of the lines in the first set of feet placement lines 4 and their heels with one of the lines in the second set of feet placement lines 7. Then the user aligns a golf ball 80 in the training space 16 created between the long portion 24*b* of the alignment arm 24, the short portion 24*a* of the alignment arm 24, the forward side 31 of the body 26, and the flexible arm 8 with the center lines 6 of long portion 24*b* of the alignment arm 24, and the body 26. The flexible arm 8 is moved to a position, (if it is not already in position), where the end of the flexible arm 8 is received within slot 22. By having the end of the flexible arm 8 received by the second slot 22 on the body 26, the proper body, arm and radius motion of the user can occur. Then, the user hits the ball towards the hole or other marker chosen. The correct pathway of the club head 90 is shown by dashed line connecting golf head 98*a* to 98*c* in FIG. 3. If the club head 90 hits the training plate or during the putt swing the golf club head 90 is not parallel to the straight arm 8 after hitting the ball 80, the user may change the feet location, ball location, take away path, or swing path before impact to obtain the correct pathway of the club head.

To use the training plate for pendulum putting strokes to a chosen marker or hole ten feet of less away from the tee, a user places the training plate a specific distance away from the hole or other chosen marker. The user may or may not use a tee or other stake to secure the training plate to the ground using holes 40, 41, 42, 46, and 47. A user then steps into the feet placement cutouts 5 and aligns their toes with one of the lines in the first set of feet placement lines 4 and their heels with one of the lines in the second set of feet placement lines 7. Then the user aligns a golf ball 80 in the training space 16 created between the long portion 24*b* of the alignment arm 24, the short portion 24*a* of the alignment arm 24, the forward side 31 of the body 26, and the flexible arm 8 with the center lines 6 of long portion 24*b* of the alignment arm 24, the center line 12 on the short portion 24*a* of the alignment arm 24, and the body 26. The flexible arm 8 is moved to a position, (if it is not already in position), where the end of the flexible arm 8 is received within slot 18 and the arm is substantially parallel to the long portion 24*b* of the alignment arm 24. By having the end of the flexible arm 8 received by the first slot 18 on the body 26, the proper body, arm and motion of the user can occur. Then, the user hits the ball towards the hole or other marker chosen. The correct pathway of the club head 90 is shown by dashed line connecting golf head 98*b* to 98*c* in FIG. 3. If the club head 90 hits the training plate or the during the putt swing the golf club head 90 is not parallel to the straight arm 8 after hitting the ball 80, the user may change the feet location, ball location, take away path, or swing path before impact to obtain the correct pathway of the club head.

To use the training plate for iron shots to a chosen marker or hole greater than 40 feet away from the tee, a user places the training plate a specific distance away from the hole or other chosen marker. The user may or may not use a tee or other stake to secure the training plate to the ground using holes 40, 41, 42, 46, and 47. A user then steps into the feet placement cutouts 5 and aligns their toes with one of the lines in the first set of feet placement lines 4 and their heels with one of the lines in the second set of feet placement lines 7. Then the user aligns a golf ball in the training space 16 created between the long portion 24*b* of the alignment arm 24, the short portion 24*a* of the alignment arm 24, the forward side 31 of the body 26, and the flexible arm 8 with the center lines 6 of long portion 24*b* of the alignment arm 24, the center line 12 on the short portion 24*a* of the alignment arm 24, and the body 26. A series of swing alignment tabs 135 are rotated to an upright position on the short portion 24*a* of the alignment arm 24. The flexible arm 8 is moved to a position, (if it is not already in position), where the end of the flexible arm 8 is received within slot 18 and the arm is substantially parallel to the long portion 24*b* of the alignment arm 24. By having the end of the flexible arm 8 received by the first slot 18 on the body 26, the proper body, arm and motion of the user can occur. Then, the user hits the ball towards the hole or other marker chosen. The correct pathway of the club head 90 is shown by dashed line connecting golf head 97*a* to 97*b* in FIG. 3. Depending on which of the tabs 135 are knocked down due to impact of the club head, the user may adjust their feet position or ball position to adjust the pathway of their swing to obtain the correct pathway of the club head.

FIG. 4 shows a training plate of a second embodiment. Instead of cutting holes or slots 18, 22 in the body 26 to receive the flexible portion 8*a* of the arm 8, a series of holes 50 a certain distance apart may be present for receiving a pin 51, and the flexible portion 8*a* of the arm 8 is flexed behind the pin 51 to change the radius of the arc of the shot a user should follow.

Additionally the arm 8 does not have to be firmly attached to the straight portion 31*a* of the forward surface 31 of the body 26 and may instead be pinned into place along the straight portion 31*a* of the forward surface of the body 26.

FIGS. 5-8 show a training plate 103 of a third embodiment that may be used for all clubs including drivers and short irons for designating proper alignment, body position, and swing path of the golf club. The training plate 103 of the third embodiment shows alignment and references the ball, feet and body position for each club and each shot taken. Shots preferably range from 50 to 300 yards.

The training plate 103 includes a generally rectangular body 126 and an L-shaped alignment arm 124. The body 126 has a top surface 127, a bottom surface (not shown), a left side 129, a right side 130, a forward side 131, and a rear side 132. Holes 146 and 147 are present on the body to secure the body 126 to the ground using golf tees or stakes if necessary. A handle 102 is preferably present near the left side 129 of the body 126 and is used to easily carry the training plate.

The alignment arm 124 is preferably slidably connected to the side 130 of the body 126 preferably through a tongue and groove arrangement 145, although the alignment arm may also just be placed next to the left side 129 or right side 130 of the rectangular body 126. The alignment arm 124 is preferably L-shaped having a short portion 124*a* and a long portion 124*b*, with the longer portion 124*b* of the "L" is substantially parallel to the forward side 131 of the body 126. A series of holes 140, 141, and 142 are present along the short portion 124*a* of the alignment arm 124 and may used with golf tees or some other type of stake to secure the alignment arm to the ground. Preferably along the short portion 124*a* of the alignment arm 124 are a series of tabs 135 that are each individually pivotably connected to the arm 124*a*. A side view of the swing alignment tabs 135 is shown in FIG. 7. The swing alignment tabs 135 are preferably comprised of a rod 138 pivotably attached to a pivot 136 with a series of tabs 137. The tabs 137 may also be feathers, bristles, brushes or any other material that may be knocked down by the golf club head without injuring the head of the club. The placement and the fact that the series of swing alignment tabs 135 can easily be knocked down indicates where the golf club head is on the swing take-away and the location and travel of the club head before impacting the ball. The tabs 135 may be reset to continue practicing and learn the correct inside swing path of the golf club head.

Figure 5:
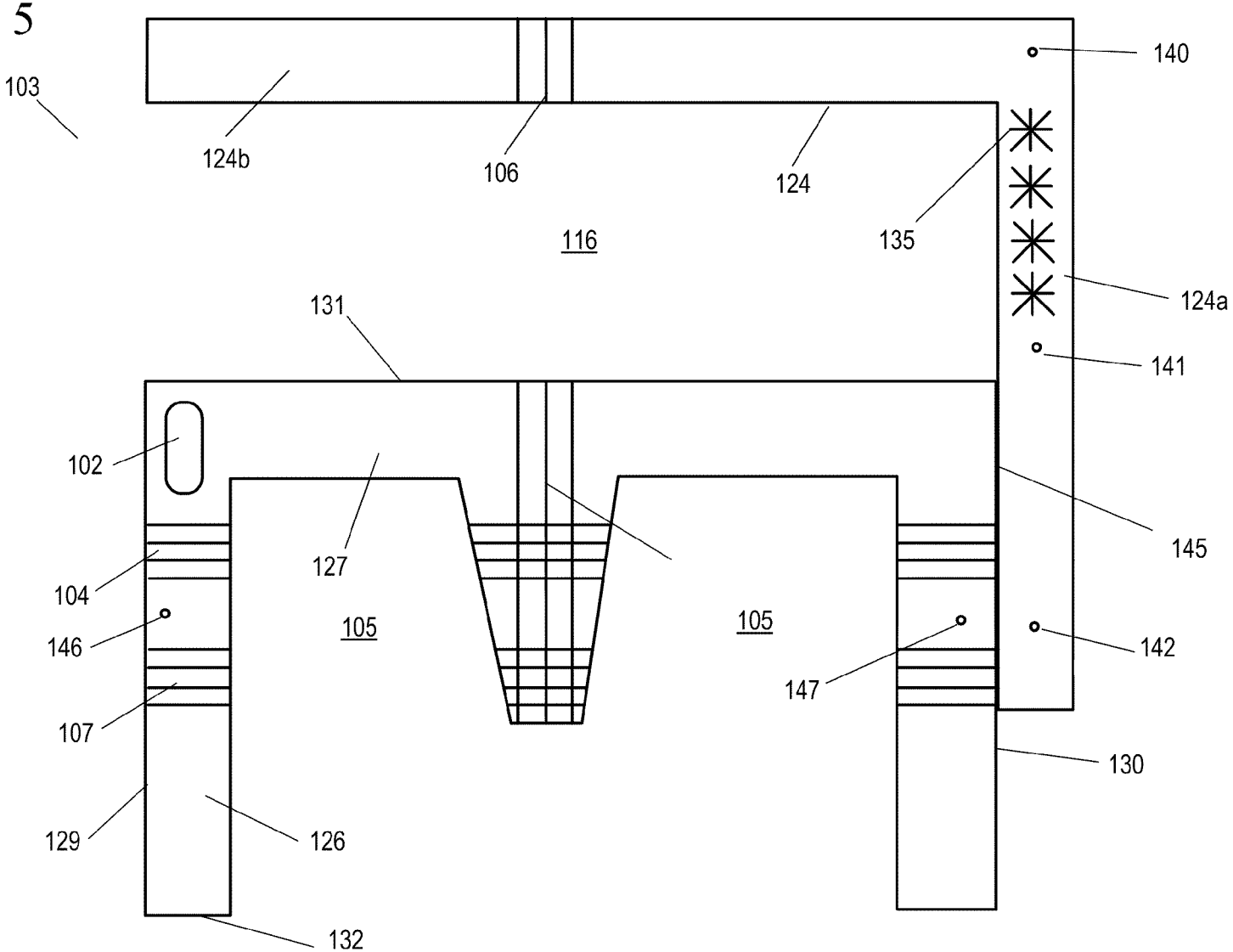
FIG. 5 shows a top view of a training plate of a third embodiment.
Figure 6:
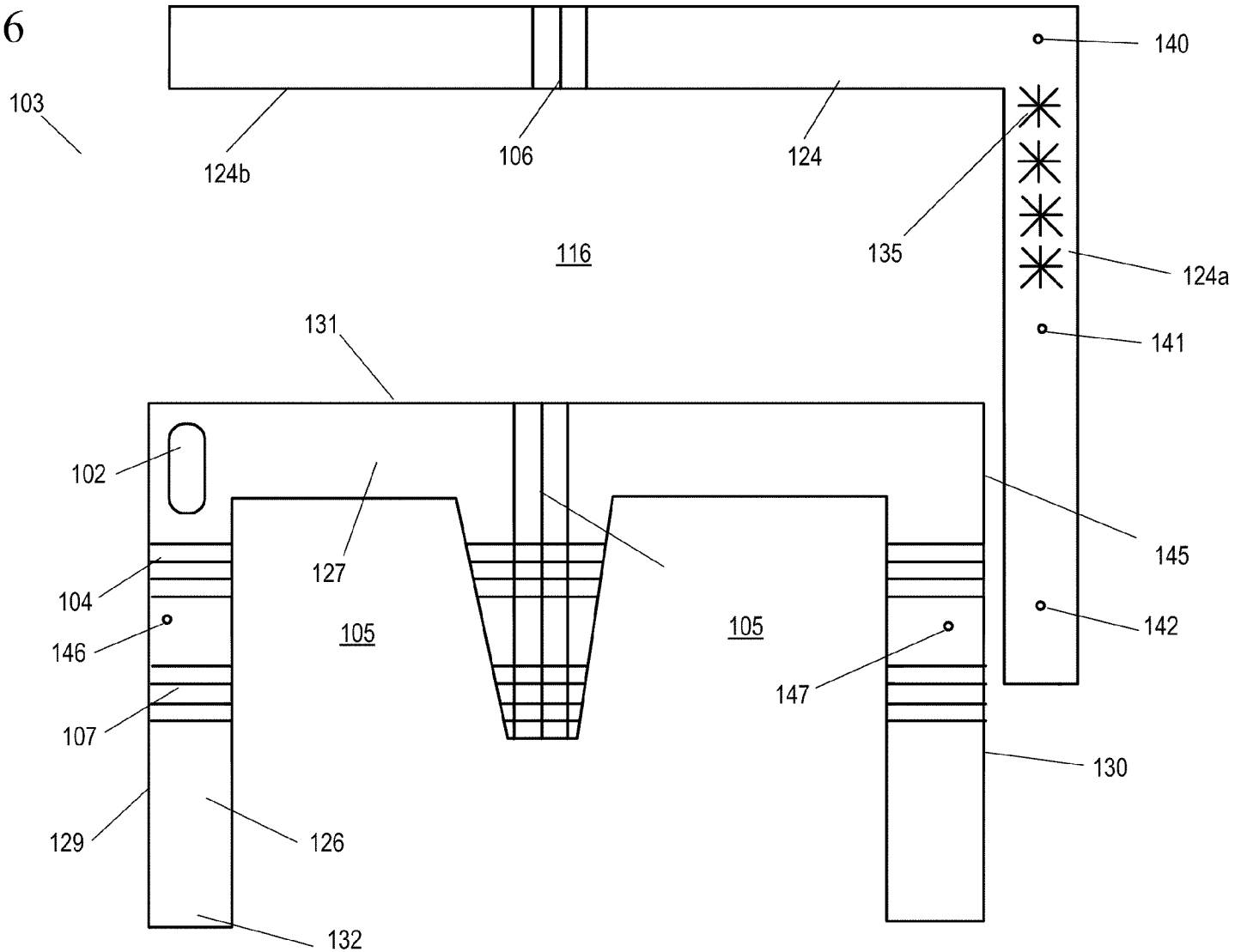
FIG. 6 shows an alternate top view of a training plate of a third embodiment.
Figure 8:
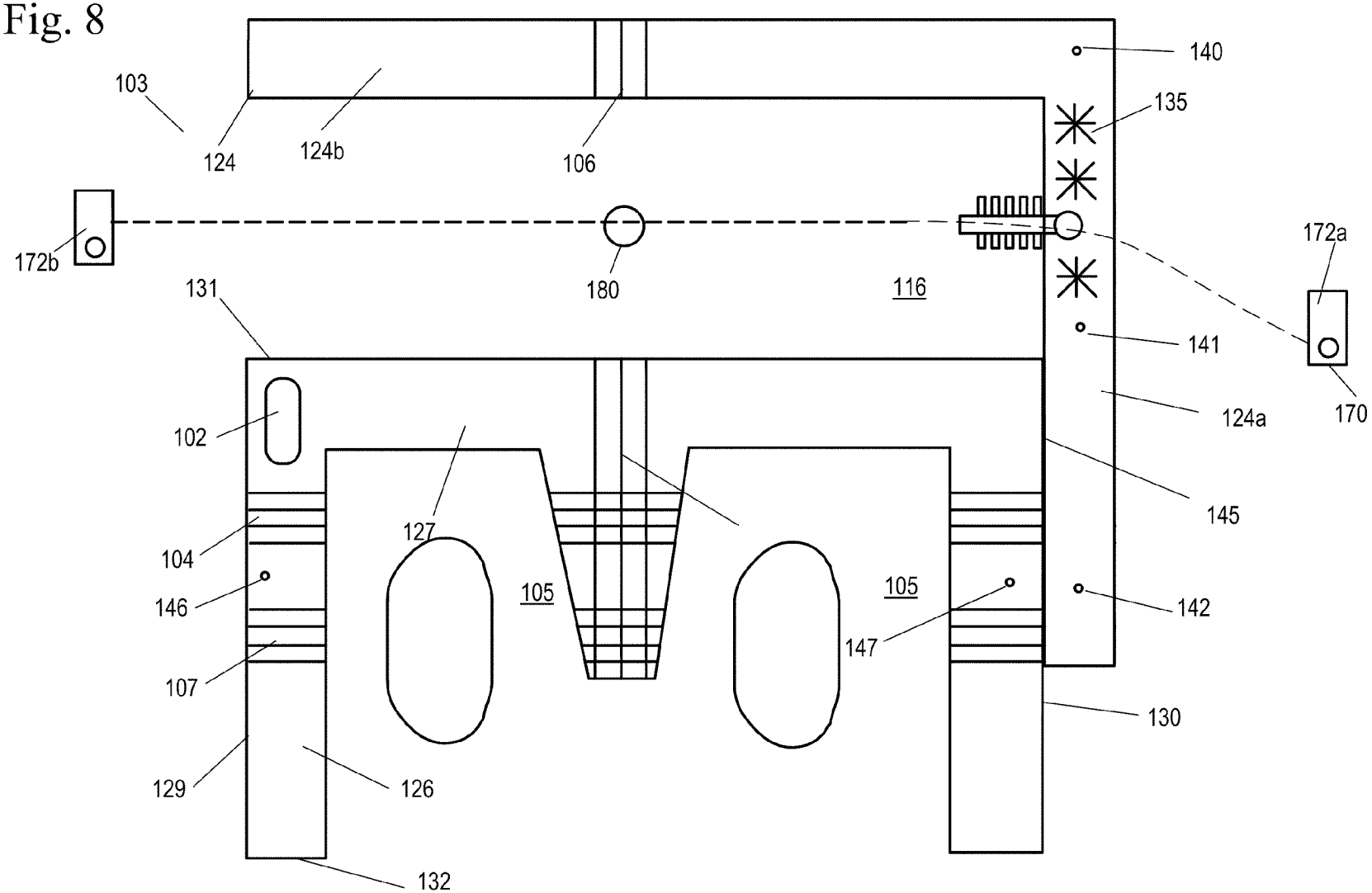
FIG. 8 shows a schematic of the training plate of the third embodiment used by a golfer.

When the training plate is laid flat and in training position, as shown in FIGS. 5-6 and 8, a training space 116 is defined between the long portion 124*b* of the alignment arm 124, the short portion 124*a* of the alignment arm 124, and the forward side 131 of the body 126. When the training plate is used by a user, at least one golf ball (not shown) is placed within the training space 116.

The body 126 defines two feet placement cutouts 105 that are widest at the rear side 132 of the body 126 and become narrower as the cutouts 105 approach the forward side 131 of the body 126. The top surface 127 of the body 126 preferably has a series of feet placement lines 104, 107 adjacent to the feet placement cutouts 105 to aid the user with proper feet placement that runs parallel to the alignment arm 124. A first set of feet placement lines 104 are located where the toes of the users would be when their feet are in the feet placement cutouts 105 and the second set of feet placement lines 107 are located where the heel of the users would be present when their feet are in the feet placement cutouts 105.

The top surface 127 of the body 126 also includes ball alignment lines 120 which are comprised of a series of parallel lines that are spaced apart a distance from each other, between the two feet placement cutouts 105, with at least one of the lines locating along a center line that is located between the left side 129 and right side 130 of the body 126 and perpendicular to the long portion 124*b* of the alignment arm 124. The lines 120 preferably extend from the rear side 132 of the body 126 to the forward side 131 of the body 126. The parallel lines 120 are preferably spaced apart from each other a distance of ⅝". The long portion 124*b* of the alignment arm 124 has corresponding ball alignment lines 106 which are comprised of a series of parallel lines that are aligned with the series of parallel lines 120 on the top surface 127 of the body 126, where at least one of the lines is located along a center line of the long portion 124*b* of the L-shaped alignment arm 124. The center line on the top surface 127 of the body 126 and the center line on the long portion 124*b* of the alignment arm 124 are used for alignment and placement of the golf ball within the training space 116.

A ball may be aligned with the training space 116, using three center lines, the center line 120 on the body 126 perpendicular to the long portion 124*b* of the alignment arm 124 and the center line 106 on the long portion 124*b* of the alignment arm 124.

The training plate is preferably made of a carbon polymer material.

The training plate 103 of the third embodiment without the tabs 135 may be used to correct a user's swing for all clubs including drivers and short irons for designating proper alignment, body position, and swing path of the golf club. To correct a user's swing, a user hits at least three shots to a target of choice which is preferably approximately 150 yards away. Then, the user or another individual marks the position of the user's feet and ball. Then, the training plate 103 is placed in position based on the markers for the user's feet and where the ball was. The placement of the training plate 103 relative to the where the user's feet and ball were when the shots towards the target were taken provides the relationship of where the ball was, the user's feet placement relative to the hole and where the arc of the user's swing had to come through. Based on the final resting position of the ball from the three shots relative to the target of choice, the ball may be moved left or right and the feet may be adjusted to turn the golfer's body and adjust the direction of the ball.

The training plate of the third embodiment with the tabs 135 may also be used to correct a user's swing for all clubs including drivers and short irons for designating proper alignment, body position, and swing path of the golf club. To correct a user's swing, a user places the training plate 103 a specific distance away from the hole or other chosen marker. The user may or may not use a tee or other stake to secure the training plate to the ground using holes 140, 141, 142, 146, and 147. A user then steps into the feet placement cutouts 105 and aligns their toes with one of the lines in the first set of feet placement lines 104 and their heels with one of the lines in the second set of feet placement lines 107. Then the user aligns a golf ball 180 in the training space 116 created between the long portion 124*b* of the alignment arm 124, the short portion 124*a* of the alignment arm 124, the forward side 131 of the body 126. A series of swing alignment tabs 135 are rotated to an upright position on the short portion 124*a* of the alignment arm 124. Then, the user hits the ball towards the hole or other marker chosen. The correct pathway of the club head 170 is shown by dashed line connecting golf head 172*a* to 172*b* in FIG. 8. Depending on which of the tabs 135 are knocked down due to impact of the club head, the user may adjust their feet position or ball position to adjust the pathway of their swing.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A golf training plate comprising:

a body rectangular in shape comprising a top surface, a left side, a right side, a forward side and a rear side having two feet placement cutouts extending from the rear side towards the forward side and a first series of parallel ball alignment lines spaced apart a distance between the two feet placement cutouts, with at least one of the lines located along a center line between the left side and right side of the body and perpendicular to the forward side of the body; and an alignment arm in the shape of an "L" comprising a short portion adjacent the right side of the body and a long portion, substantially parallel to the forward side of the body defining a training space for placement of a ball and a second series of parallel ball alignment lines aligned with the first series of parallel ball alignment lines on the top surface of the body, where at least one of the lines is located along a center line of the long portion of the alignment arm.

2. The golf training plate of claim 1, further comprising a series of swing alignment tabs individually pivotally attached to the short portion of the alignment arm.

3. The golf training plate of claim 2, wherein the swing alignment tabs further comprises a rod with a series of tabs, the rod pivotably attached to the short portion of the alignment arm.

4. The golf training plate of claim 3, wherein the tabs are selected from a group consisting of feathers, bristles and brushes.

5. The golf training plate of claim 1, wherein the alignment arm is hingedly attached to the body.

6. The golf training plate of claim 1, wherein the forward side of the body is curved.

7. The golf training plate of claim 6, further comprising a straight arm attached to the forward side of the body comprising a flexible portion at one end received in a first slot or a second slot defined by the right side of the body.

8. The golf training plate of claim 1, further comprising an arm with a length attached to the forward side of the body, and having a flexible portion at an end.

9. The golf training plate of claim 8, further comprising slots in the right side of the body for receiving the flexible portion of the arm in a first position or a second position.

10. The golf training plate of claim 8, wherein in the first position the arm is substantially parallel to the long portion of the alignment arm.

11. The golf training plate of claim 8, wherein in the second position the flexible portion of the arm is radiused.

12. The golf training plate of claim 8, further comprising pins spread apart a distance on the right side of the body for securing the flexible portion of the arm in place.

* * * * *